US006890604B2

(12) United States Patent
Daniels

(10) Patent No.: US 6,890,604 B2
(45) Date of Patent: May 10, 2005

(54) METHOD AND SYSTEM FOR POWDER COATING PASSAGE DOORS

(75) Inventor: Evan R. Daniels, Dallas, TX (US)

(73) Assignee: Trio Industries Holdings, LLC, Dallas, TX (US)

( * ) Notice: Subject to any disclaimer, the term of this patent is extended or adjusted under 35 U.S.C. 154(b) by 0 days.

(21) Appl. No.: 10/144,169

(22) Filed: May 13, 2002

(65) Prior Publication Data

US 2003/0211237 A1 Nov. 13, 2003

(51) Int. Cl.[7] ..... B05D 1/04

(52) U.S. Cl. ..... 427/477; 427/475; 427/485; 52/784.1

(58) Field of Search ..... 427/471–485; 156/292; 52/784.1, 784.13, 455; 361/227

(56) References Cited

U.S. PATENT DOCUMENTS

| | | | | |
|---|---|---|---|---|
| 4,146,924 A | | 3/1979 | Birk et al. | |
| 4,901,666 A | | 2/1990 | Nagasaka et al. | |
| 5,084,952 A | | 2/1992 | Grabow | |
| 5,136,971 A | | 8/1992 | Blankemeyer et al. | |
| 5,163,222 A | | 11/1992 | Imlig et al. | |
| 5,164,011 A | * | 11/1992 | Ray | 118/500 |
| 5,299,693 A | | 4/1994 | Ubaldi et al. | |
| 5,438,740 A | | 8/1995 | Carr et al. | |
| 5,468,101 A | | 11/1995 | Shoda | |
| 5,551,980 A | * | 9/1996 | Turnbo | 118/500 |
| 5,562,197 A | | 10/1996 | Vaphiadis | 198/776 |
| 5,668,307 A | | 9/1997 | Wade | |
| 5,731,043 A | * | 3/1998 | Horinka et al. | |
| 5,771,656 A | * | 6/1998 | Amoretti | |
| 5,807,608 A | | 9/1998 | O'Dell et al. | |
| 5,894,648 A | | 4/1999 | Hill et al. | |
| 5,980,184 A | | 11/1999 | Lust et al. | |
| 5,997,959 A | * | 12/1999 | Lebioda | |
| 6,094,793 A | | 8/2000 | Szuba | |
| 6,110,316 A | | 8/2000 | Kobayashi et al. | |
| 6,153,267 A | * | 11/2000 | Horinka et al. | 427/475 |
| 6,182,955 B1 | | 2/2001 | Kimble | |
| 6,268,022 B1 | * | 7/2001 | Schlegel et al. | |
| 6,387,330 B1 | | 5/2002 | Bova et al. | |
| 6,419,216 B1 | | 7/2002 | Sunsjara | |
| 6,459,952 B1 | | 10/2002 | Dundorf | |
| 6,551,833 B1 | | 4/2003 | Lehtinen et al. | |

FOREIGN PATENT DOCUMENTS

| | | | |
|---|---|---|---|
| EP | 0933140 A1 | * | 8/1999 |
| EP | 0 933 140 | * | 8/1999 |

* cited by examiner

*Primary Examiner*—Fred J. Parker
(74) *Attorney, Agent, or Firm*—Daniel J. Chalker; Chalker Flores, LLP

(57) ABSTRACT

A method of applying a powder coating to a medium density fiberboard (MDF) or particleboard door includes attaching a first hanger to the door, providing an electrical source to the door through the first hanger, and conveying the door, via the first hanger, into a coating booth. The door is then powder-coated in the coating booth while being electrostatically charged. The powder-coated door is then cured to cause the powder to adhere to the door.

8 Claims, 2 Drawing Sheets

METHOD AND SYSTEM FOR POWDER COATING PASSAGE DOORS

The present invention relates to powder coating and, more particularly to, an improved method of powder coating interior and exterior passage doors made from medium density fiberboard or particleboard.

BACKGROUND OF THE INVENTION

New construction put in place during August 2001 was estimated at a seasonally adjusted annual rate of $845.5 billion according to the U.S. Commerce Department's Census Bureau. Additionally, expenditures for improvements and repairs of residential properties in the first quarter of 2001 were at a seasonally adjusted annual rate of $169.3 billion. The cost of building materials is a significant portion of the total cost of new construction and home improvement. Consequently, building material manufacturers are continuously searching for new methods of improving their products and reducing their costs to gain a larger portion of this enormous market for building materials.

Door manufacturers, for example, have developed many manufacturing processes to improve their doors for the consumer. Innovative manufacturing techniques to produce hollow core doors reduce the expense of the door as compared to a solid door while maintaining functional features such as noise reduction and structural integrity. Alternative door materials such as medium density fiberboard (MDF) and particleboard may also reduce the cost of the door while maintaining functional features. Building doors with alternative materials or by innovative techniques, however, may result in an unfinished door that lacks the aesthetic qualities of an unfinished wood door, which are important for appealing to the consumer.

Many manufacturers apply a primer or finish coating to the door to appeal to the consumer. Primed or finished doors save the consumer time and effort and also have a more attractive appearance to some builders and consumers. Primer and paint coatings may be applied to the doors in an automated fabrication process. These coatings, however, typically require specialized equipment such as paint sprayers, separate paint booths, ventilation equipment, and driers to apply an attractive or useful coating to the doors. This specialized equipment consequently increases the cost of the finished door. Priming and painting also produces a variable finish quality according to the amount of material sprayed onto the door. Overspray may result in drips and wasted primer and paint while color variations may result from using an inadequate volume of primer and paint. Additionally, primers and paints typically contain volatile organic compounds (VOC's) that are vented to the environment. Permits to vent the VOC's and customer perception of the environmental impact of manufacturing processes may also increase the cost or consumer acceptance of the door.

Powder coating has been used as an alternative to priming and painting many metallic surfaces of building materials and components such as mailboxes, water heaters, window frames, and HVAC equipment, for example. The unique application characteristics of powder coatings provide superior consistency and uniformity of finish without drips, runs, or bubbles. Powder coating provides tough, durable films, enhancing the quality appearance of building materials. In general, performance properties such as impact resistance, flexibility, and corrosion resistance, of powder coatings are better than liquid paints. Powder coated building materials resist cracking, peeling, and marring during handling and normal service use.

Powder coating frequently costs less than priming and painting a product. Production costs are conserved through energy savings, labor costs, rework costs, reduced material usage, reduced waste disposal costs, and an increase in overall line efficiency. One advantage to manufacturers and consumers is that powder coated building materials have a superior quality finish at a reasonable cost.

Powder coating building materials is also more environmentally sound than painting. Environmental issues are a significant interest to the government and consumers. Unlike many primers and paints, powder coatings comply with environmental regulations. Primers and paints often contain VOC's, which can contribute to air pollution and, in some cases, ozone depletion. Powder coatings contain minimum amounts of VOC's and, therefore, may be perceived by the consumer to be environmentally friendly. Wet painting processes may also generate sludge, which must be disposed in hazardous waste landfills. This disposal increases the cost of the building products. Properly formulated powder coatings generate no hazardous waste. Unused or excess powder may be reclaimed and recycled, which also reduces overall product cost.

It would, therefore, be desirable to have an improved method of finishing passage doors that does not produce an unsightly finish. It would also be desirable to have an improved method of finishing passage doors that is not as costly as conventional finishing methods. Further, it would be desirable to have an improved method of finishing passage doors that is not detrimental to the environment.

SUMMARY OF THE INVENTION

The present invention is a system for powder coating a passage door. The system has a coating booth hanger to electrically charge and suspend the passage door from an overhead conveyor within the coating booth. A powder dispenser distributes powder to the passage door. A curing device cures the powder that is distributed on the passage door.

In one embodiment of the invention, a method of applying a powder coating to a door has the step of hanging a door in a coating booth. Powder is distributed to the coating booth where the door is grounded to attract electrostatically charged powder. Then the powder is cured to adhere to the door.

In another embodiment of the invention, a method of manufacturing a powder coated door has the step of coating a first door half and a second door half with a powder. The powder on the first door half and the second door half is then cured. The first door half is then joined to the second door half to form a complete door.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention is discussed in detail below, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

A method of powder coating passage doors according to one embodiment of the present invention has many desirable features that were previously unavailable to those in the business of powder coating. Although methods for powder coating wood were known, economically powder coating doors presented several problems such as the difficulty of hanging the passage door on a powder coating conveyor. Powder coating objects typically requires that a hangar ground the object so that the object and the powder have opposite electrical charges. This opposite charge uniformly attracts the positively charged powder to surface of the object where the powder may be cured. Curing the powder results in a desirable finish being formed on the object. In the case of passage doors, however, both sides of the finished door must be attractively finished. Therefore, hanging the passage door from either face may leave an unattractive hole in the door that must be patched. Patching holes increases manufacturing costs and does not guarantee that consumers will be satisfied with the overall appearance of the door. As will be described in more detail with reference to the figures, one embodiment of the present invention produces doors without the added expense of patching holes on the visible surfaces of the door.

Figure 1:
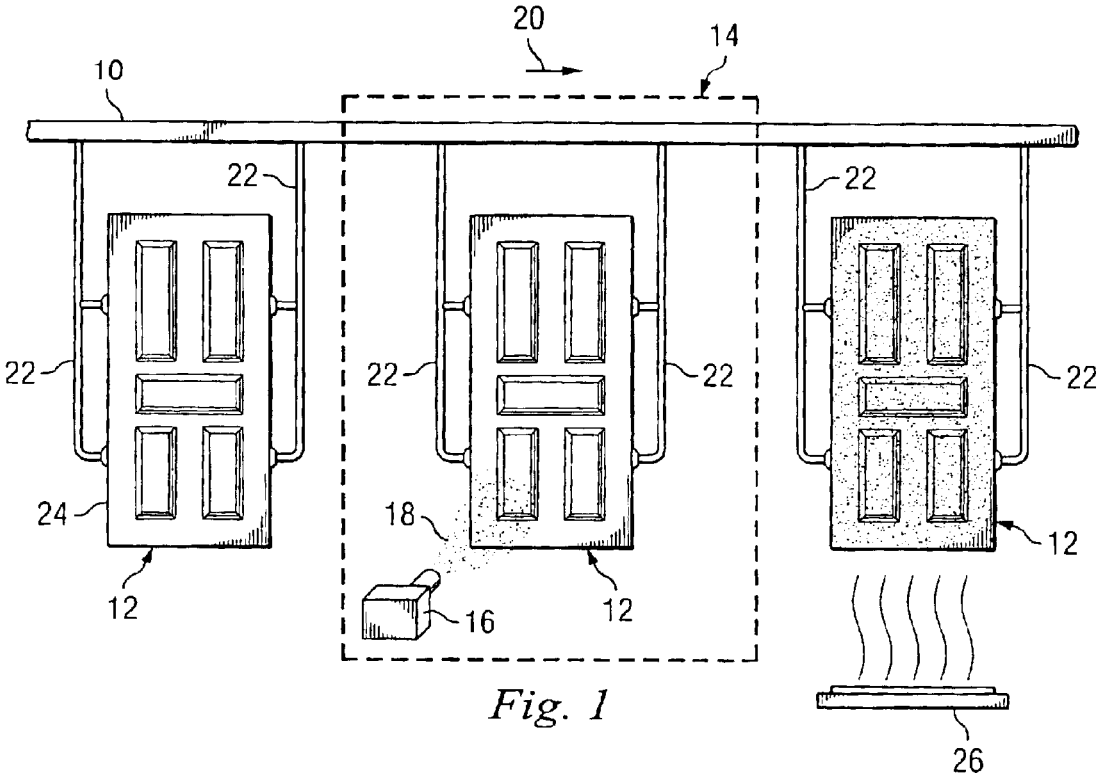
FIG. 1 is a schematic view of a powder coating conveyor that depicts an embodiment of the present invention.

Referring now to the figures and, in particular to FIG. 1, a conveyor 10 is configured to convey a door 12 through a powder coating booth 14. A powder dispenser 16 may be located within the powder coating booth 14 and dispenses a powder 18 to the door 12. The conveyor 10 conveys the door 12 through the powder coating booth 14 in the direction indicated by arrow 20. A hanger 22 may support the door 12 by one or more edges 24 as the door 12 is conveyed through the powder coating booth 14. A curing device 26 cures the powder 18 after the powder 18 has been applied to the door 12.

The conveyor 10 may be a typical conveyor for powder coating operations that is known to those having ordinary skill in powder coating. The conveyor 10 conveys one or more doors 12 through the powder coating booth 14. The conveyor 10 may be configured to support the weight of several doors 12 to improve the efficiency of a manufacturing operation. Multiple doors 12 may be loaded onto the conveyor 10 and conveyed through the powder coating booth 14 at a relatively high conveyor speed to continuously apply the powder 18 to the doors 12. Those having ordinary skill in powder coating will be aware that conveyor speed may be limited by the speed at which a desired volume of powder 18 may be deposited or applied to the door 12. Additionally, the conveyor speed may be limited by how fast the applied powder 18 may be cured.

The powder coating booth 14 may be a typical powder coating booth for powder coating operations that is known to those having ordinary skill in powder coating. The powder coating booth 14 must be large enough to accept one or more doors 12 for powder coating. The powder dispenser 16 may be a typical dispenser known to those having ordinary skill in powder coating, such as the corona method dispenser or the triboelectric dispenser, for example. Other methods of applying powder 18 to the door will be apparent to those having ordinary skill in powder coating.

The powder 18 may be, for example, powder of the type described in U.S. Pat. Nos. 5,907,020 or 6,077,610 to Correll et al., U.S. Pat. No. 5,721,052 to Muthiah et al, or U.S. Pat. No. 5,714,206 to Daly et al. These patents are all assigned to Morton International, Inc. and disclose powder coating systems that are suitable for coating wood-based products. The powder 18 may be configured to produce a smooth or a textured finish on the door 12. In some instances, a wood grain texture, for example, may be produced by configuration of the powder. Other desirable finish characteristics will be apparent to those having ordinary skill in powder coating wood-based products.

The curing device 26, which may incorporate an infrared, ultraviolet, or thermal curing process, for example, cures the powder 18 after the powder 18 is applied to the door. The powder 18 is configured to cure at temperatures that will not adversely affect the door 12. As discussed above with reference to coating speed, the conveyor speed may also be limited by the rate that the curing device 26 is capable of curing the powder 18 on the door 12.

The door 12 may be made from a variety of wood or wood-based materials such as particleboard, MDF, and the like. The door 12 may also be made from a combination of these materials. The powder coating method described herein may be used for interior and exterior passage doors, cabinet doors and other doors 12. The door 12 may be preheated before being conveyed to the powder coating booth 14 to enhance the adhesion of the coating onto the door 12.

Because both inside and outside surfaces of many doors 12 are visible in normal installations, the hanger 22 holds the door by the edge 24. Holding the door 12 by the edge 24 reduces potential blemishes that may remain on the surface of the door 12 if the door 12 were held by another method. The hanger 22 may hold the edge 24 in more than one location to increase the stability of the door 12 as it is conveyed through the powder coating process. As depicted in FIG. 1, for example, the door 12 is suspended at two points on opposite edges 24. The edges 24 may be on the sides, top or bottom of the door depending on the dimensions of the door 12 or a desired orientation. The orientation of the door 12 may be varied according to the configuration of the conveyor 10, the powder coating booth 14, or the curing device 26. Additionally, the orientation of the door 12 may be adjusted or changed during the powder coating process.

Several different interfaces may be used to securely hold and electrically ground the door 12 during the powder coating process. In a typical powder coating process, a product to be powder coated is hung from a conductive rod. A round hole in the product accepts the rod, which is slightly smaller in diameter than the hole, and secures the product during the process. After the powder coating process, however, the hole in the product remains and must be filled unless the hole is not located on a visible surface.

Figure 2:
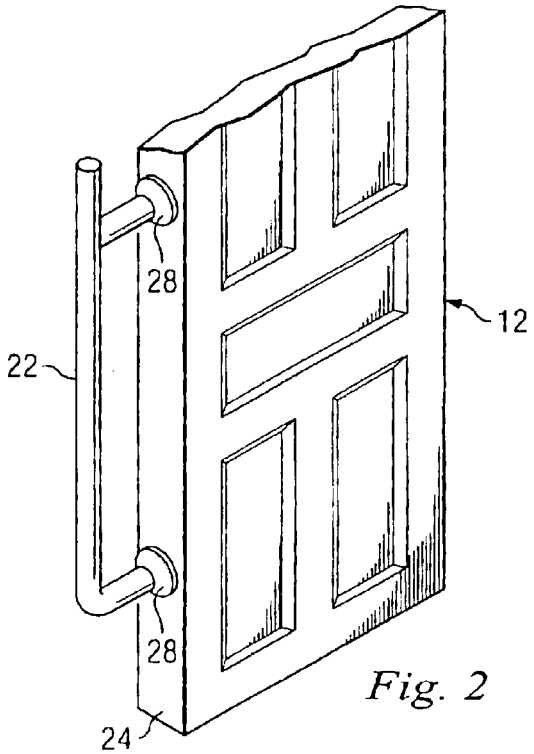
FIG. 2 is detail view of a door hanger that depicts an embodiment of the present invention.

Turning now to FIG. 2, different interfaces for hanging the door 12 are depicted. The edge 24 of the door 12 has round holes 28 that are slightly larger in diameter than the hanger 22. After the door 12 is powder coated, the holes 28 may be filled with dowels or wood filler, for example, to improve the aesthetics of the door 12. Alternatively, the holes 28 may be left open because the edge 24 may not be visible after the door 12 is installed. If, for example, the holes 28 are located on the top or bottom edges 24 of the door 12, the holes 28 may not be visible. Alternatively, if the holes 28 are located in an edge 24 on the side of the door 12, for example, hinges, locksets, or other hardware may cover the holes 28. In this particular example, the hanger 22 supports the edge 24 of the door in two locations to increase the stability and secure the door 12 during the powder coating process. Other methods of hanging the door 12 from the edge 24 will be apparent to those having ordinary skill in powder coating.

Figure 3:
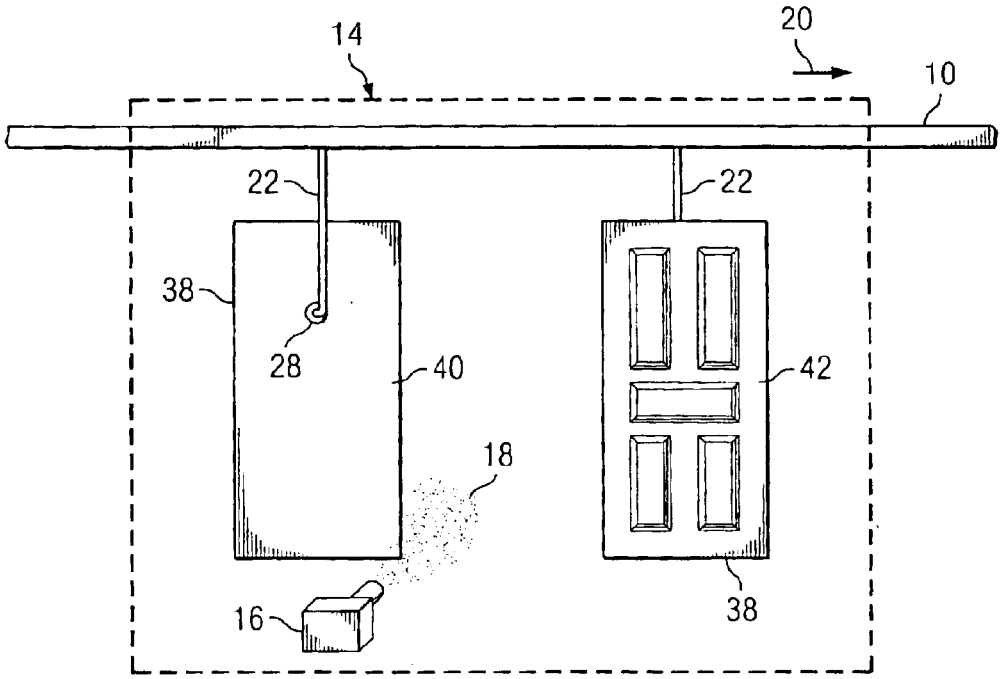
FIG. 3 is a schematic view of a powder coating conveyor that depicts an embodiment of the present invention.

Referring now to FIG. 3, another embodiment of the present invention is depicted. The door 12 may be manufactured in two separate door sections 38. The door sections may be made from particle board, MDF, wood-based material, or the like. The hanger 22 may hang the door sections 38 from a hole 28 in a back surface 40. A generally teardrop-shaped hole may also be formed in the back surface 40 to facilitate automatically loading the door section 38 onto the hanger 22. After the front surface 42 of the individual door sections 38 are powder coated, the back surfaces 40 of the door sections 38 are joined to form a complete door 12. Consequently, the hole 28 does not require filling because it will not be visible when the door 12 is assembled.

Figure 4:
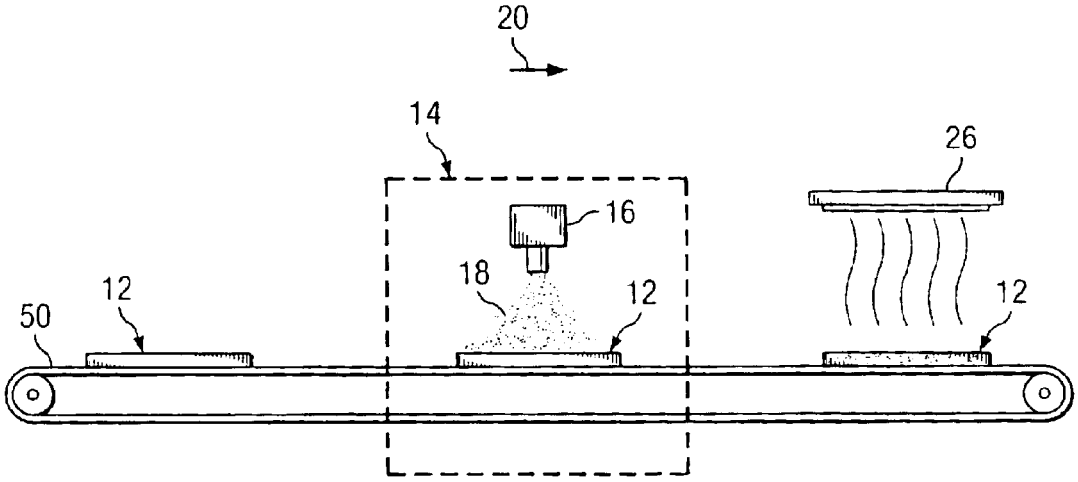
FIG. 4 is a schematic view of a horizontal powder coating conveyor that depicts an embodiment of the present invention.

Turning now to FIG. 4, an alternative embodiment of powder coating a door 12 is depicted. The door 12 may be placed onto a horizontal conveyor 50. Contact between the door 12 and the horizontal conveyor 50 electrically grounds the door 12 for powder coating. The horizontal conveyor 50 is configured to convey the door 12 through the powder coating booth 14. The powder dispenser 16 may be located within the powder coating booth 14 and dispenses a powder 18 to the door 12. The conveyor 50 conveys the door 12 through the powder coating booth 14 in the direction indicated by arrow 20. The curing device 26 cures the powder 18 after the powder 18 has been applied to the door 12.

The horizontal conveyor 50 conveys one or more doors 12 through the powder coating booth 14. The horizontal conveyor 50 may be configured to convey several doors 12 in an efficient layout, such as side-by-side or end-to-end, for example, according to the most efficient manufacturing layout. Multiple doors 12 may be loaded onto the horizontal conveyor 50 and conveyed through the powder coating booth 14 at a relatively high conveyor speed to continuously apply the powder 18 to the doors 12. Those having ordinary skill in powder coating will be aware that conveyor speed may be limited by the speed at which a desired volume of powder 18 may be deposited or applied to the door 12. Additionally, the conveyor speed may be limited by how fast the applied powder 18 may be cured.

Whereas the invention has been shown and described in connection with the preferred embodiment thereof, it will be understood that many modifications, substitutions and additions may be made which are within the intended broad scope of the appended claims. There has therefore been shown and described an improved powder coating system that accomplishes at least all of the above stated advantages.

What is claimed is:

1. A method of applying a powder coating to a passage door having a first section and a second section, the method comprising the steps of:

attaching a first hanger to a back surface of the first door section;

attaching a second hanger to a back surface of the second door section;

providing an electrical source to the first and second door sections through the first and second hangers respectively;

conveying the first and second door sections, via the first and second hangers respectively, into a coating booth;

distributing powder to the coating booth;

electrostatically charging the first and second door sections through the first hanger and second hanger, respectively, to attract the powder;

curing the powder to cause the powder to adhere to the first and second door sections; and joining the back surfaces of the first and second door sections together to form the passage door.

2. The method of claim 1 wherein the step of curing the powder is by thermal curing.

3. The method of claim 1 wherein the step of curing the powder is by infrared light.

4. The method of claim 1 wherein the step of curing the powder is by ultraviolet light.

5. The method of claim 1 wherein the first door section and second door section are particleboard.

6. The method of claim 1 wherein the first door section and second door section arc medium density fiberboard.

7. The method of claim 1 wherein the step of attaching the first hanger and second hanger includes attaching the first hanger to the first door section and the second hanger to the second door section from one or more holes in the respective door sections.

8. The method of claim 1 further comprising the step of changing the orientation of the first and second door sections while the first and second door sections are electrostatically charged through the first hanger and second hanger to attract the powder.

* * * * *